US008974191B2

(12) United States Patent
Miura et al.

(10) Patent No.: US 8,974,191 B2
(45) Date of Patent: Mar. 10, 2015

(54) AIR COMPRESSOR

(75) Inventors: Masahiro Miura, Ibaraki (JP); Seiichi Kodato, Ibaraki (JP); Hiroki Kitagawa, Ibaraki (JP); Tomoyoshi Yokota, Ibaraki (JP); Kenichi Matsunaga, Ibaraki (JP); Yoshimi Takahashi, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 214 days.

(21) Appl. No.: 13/407,390

(22) Filed: Feb. 28, 2012

(65) Prior Publication Data

US 2012/0251346 A1 Oct. 4, 2012

(30) Foreign Application Priority Data

Mar. 31, 2011 (JP) ..... 2011-078511

(51) Int. Cl.

| | |
|---|---|
| ***F04B 41/02*** | (2006.01) |
| ***F04B 45/06*** | (2006.01) |
| ***F04B 35/06*** | (2006.01) |
| ***F04B 39/06*** | (2006.01) |

(52) U.S. Cl.

CPC ..... *F04B 41/02* (2013.01); *F04B 35/06* (2013.01); *F04B 39/066* (2013.01)

USPC ..... 417/234

(58) Field of Classification Search

CPC ..... F04B 39/06; F04B 53/00; F04B 41/02; F04B 49/00; F04B 35/06

USPC ..... 417/410.1, 234, 415, 313

See application file for complete search history.

(56) References Cited

U.S. PATENT DOCUMENTS

| | | | | |
|---|---|---|---|---|
| 1,756,806 | A * | 4/1930 | Beach | 137/899.4 |
| 2008/0112823 | A1 * | 5/2008 | Yoshida et al. | 417/410.1 |
| 2009/0016904 | A1 * | 1/2009 | Mannen et al. | 417/279 |
| 2010/0047085 | A1 * | 2/2010 | Ritterling et al. | 417/234 |

FOREIGN PATENT DOCUMENTS

| | | | |
|---|---|---|---|
| EP | 2088320 | A2 | 8/2009 |
| JP | 2000-283046 | A | 10/2000 |
| JP | 2001-221162 | A | 8/2001 |

(Continued)

OTHER PUBLICATIONS

European Search Report for application EP12157539.3 (May 30, 2012).

(Continued)

*Primary Examiner* — Devon Kramer
*Assistant Examiner* — Jon Hoffmann
(74) *Attorney, Agent, or Firm* — Kilpatrick Townsend & Stockton LLP

(57) ABSTRACT

An air compressor includes a motor, an air compression mechanism driven by the motor, a rotation shaft rotatable integrally with a rotor of the motor, a fan rotatable integrally with the rotation shaft, a plurality of air tanks for reserving compressed air generated by the air compression mechanism, and a control unit for controlling the motor. The plurality of air tanks are juxtaposed with each other and arrayed in an array direction. The plurality of air tanks includes an endmost air tank and an adjacent air tank adjacent to the endmost air tank. The control unit is disposed adjacent to and opposite to the adjacent air tank relative to the endmost air tank. The control unit is disposed adjacent to and in confrontation with an outer circumference of the fan.

12 Claims, 3 Drawing Sheets

(56) References Cited

FOREIGN PATENT DOCUMENTS

| | | | |
|---|---|---|---|
| JP | 2006188954 | A | 7/2006 |
| JP | 2001-003869 | A | 1/2011 |

OTHER PUBLICATIONS

Japan Patent Office office action for patent application JP2011-078511 (Oct. 9, 2014).

* cited by examiner

AIR COMPRESSOR

CROSS REFERENCE TO RELATED APPLICATION

This application claims priority from Japanese Patent Application No. 2011-078511 filed Mar. 31, 2011. The entire content of the priority application is incorporated herein by reference.

TECHNICAL FIELD

The present invention relates to an air compressor to supply compressed air to a power tool whose power source is compressed air.

BACKGROUND

There is a well known air compressor configured to supply compressed air to a pneumatically operated fastener driving tool in which compressed air is used as a power source. Such an air compressor includes a pair of air tanks, a motor, a fan, an air compression mechanism, and a control unit. The air compressor also includes a housing with which the motor and the air compression mechanism are covered. The compression mechanism includes a crank shaft, a cylinder, a piston, and a cylinder head.

In the air compressor, rotation of the motor is converted into a reciprocating movement of the piston in the cylinder via the crank shaft. In association with the reciprocating movement of the piston, air flows into the cylinder through an inlet port formed in a valve seat provided at a position between the cylinder and the cylinder head, so that the air is compressed in the cylinder. The compressed air flows out of the cylinder through an outlet port formed in the valve seat to flow into the pair of air tanks via a pipe. The compressed air is reserved in the pair of air tanks.

The pair of air tanks is arranged parallel to each other with respect to its axial direction. The control unit serving to control the motor to drive is disposed so as to be interposed between the pair of air tanks. Further, the motor is disposed above the pair of air tanks. The motor includes an output shaft that is arranged parallel to the axial direction of the pair of air tanks. The fan is rotatable coaxially and integrally with the output shaft of the motor. Further, the fan is disposed substantially above the pair of air tanks and closer to one end of the pair of air tanks in the axial direction than a remaining one end thereof. Rotation of the fan generates airflow in a gap formed between the pair of air tanks, thereby cooling down the control unit that generates heat when driving the motor. US patent application publication No. 2008/0112823 discloses such an air compressor.

SUMMARY

However, the above-described conventional air compressor is unable to sufficiently cool down a portion of the control unit that is positioned farther from the fan, while another portion of the control unit that is positioned closer to the fan can be sufficiently cooled down.

In view of the foregoing, it is an object of the present invention to provide an air compressor capable of sufficiently cooling a control unit. Further, it is another object of the present invention to provide an air compressor with a lightweight and downsized structure.

In order to attain the above and other objects, the present invention provides an air compressor including a housing, a motor, an air compression mechanism, a rotation shaft, a fan, a plurality of air tanks, and a control unit. The motor is disposed in the housing and has a rotor. The air compression mechanism is driven by the motor to generate compressed air. The rotation shaft is rotatable integrally with the rotor. The axial flow fan is disposed in the housing and rotatable integrally with the rotation shaft to generate airflow. The fan defines an outer circumference. The plurality of air tanks is juxtaposed with each other and arrayed in an array direction. Each of the plurality of air tanks has a hollow cylindrical configuration with an axis. Each of the plurality of air tanks is configured to reserve the compressed air generated by the air compression mechanism. The plurality of air tanks includes an endmost air tank and an adjacent air tank adjacent to the endmost air tank in the array direction. The control unit is configured to control the motor and disposed adjacent to and opposite to the adjacent air tank relative to the endmost air tank in the array direction. The control unit is disposed adjacent to and in confrontation with the outer circumference of the fan.

According to another aspect, the present invention provides an air compressor includes a housing, a motor, an air compression mechanism, a rotation shaft, a fan, an air tank, and a control unit. The motor is disposed in the housing and has a rotor. The air compression mechanism is driven by the motor to generate compressed air. The rotation shaft is rotatable integrally with the rotor. The fan is disposed in the housing and rotatable integrally with the rotation shaft to generate airflow. The fan defines an outer circumference. The air tank has a hollow cylindrical configuration with an axis. The air tank is configured to reserve the compressed air generated by the air compression mechanism. The control unit is configured to control the motor. The rotation shaft extends in a direction substantially perpendicular to the axis of the air tank. The control unit has an elongated configuration in a direction parallel to the axis of the air tank and is disposed adjacent to the air tank and the outer circumference of the fan.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
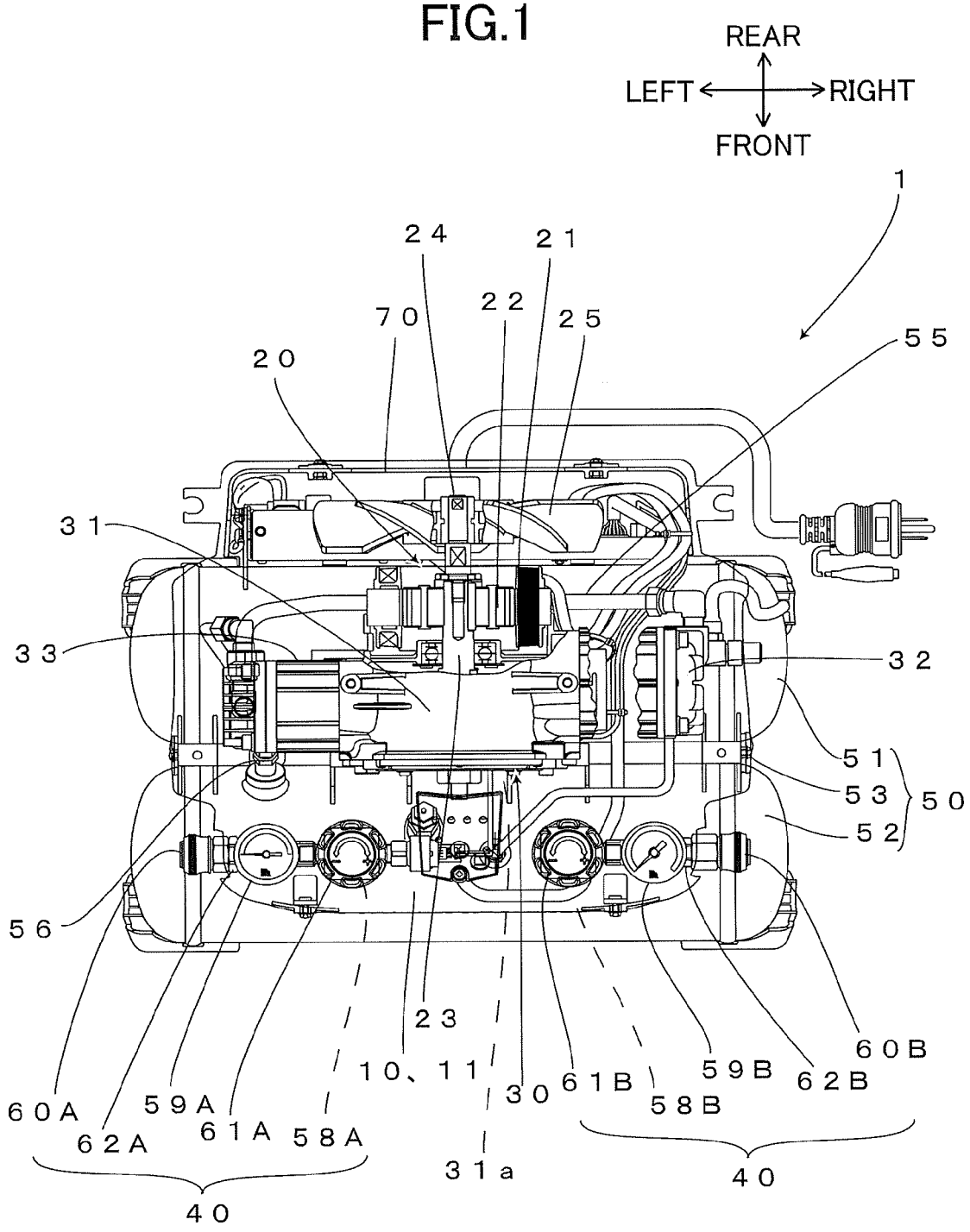
FIG. 1 is a plan view of an air compressor provided with a fan according to one embodiment of the present invention.

An air compressor according to one embodiment of the present invention will be described while referring to FIGS. 1 to 3 wherein like parts and components are designated by the same reference numerals to avoid duplicating description.

The portable type air compressor 1 serves to supply compressed air to a pneumatic tool such as a pneumatically operated fastener driving tool. The total weight of the air compressor 1 is approximately 12.9 kg. The air compressor 1 is capable of supplying one hundred and ten (110) liters per minute of compressed air with a maximum pressure of 4.5 MPa. As shown in FIG. 1, the air compressor 1 includes a housing 10, a motor 20, an axial flow fan, 25, an air compression mechanism 30, a compressed air take off unit 40, a tank unit 50, and a control unit 70.

In the following description, the terms "upward", "downward", "upper", "lower", "above", "below", "beneath", "right", "left", "front", "rear" and the like will be used assuming that the air compressor 1 is disposed in an orientation in which it is intended to be used. More specifically, left, right, top, and bottom sides in FIG. 1 are left, right, rear, and front sides of the air compressor 1.

Figure 2:
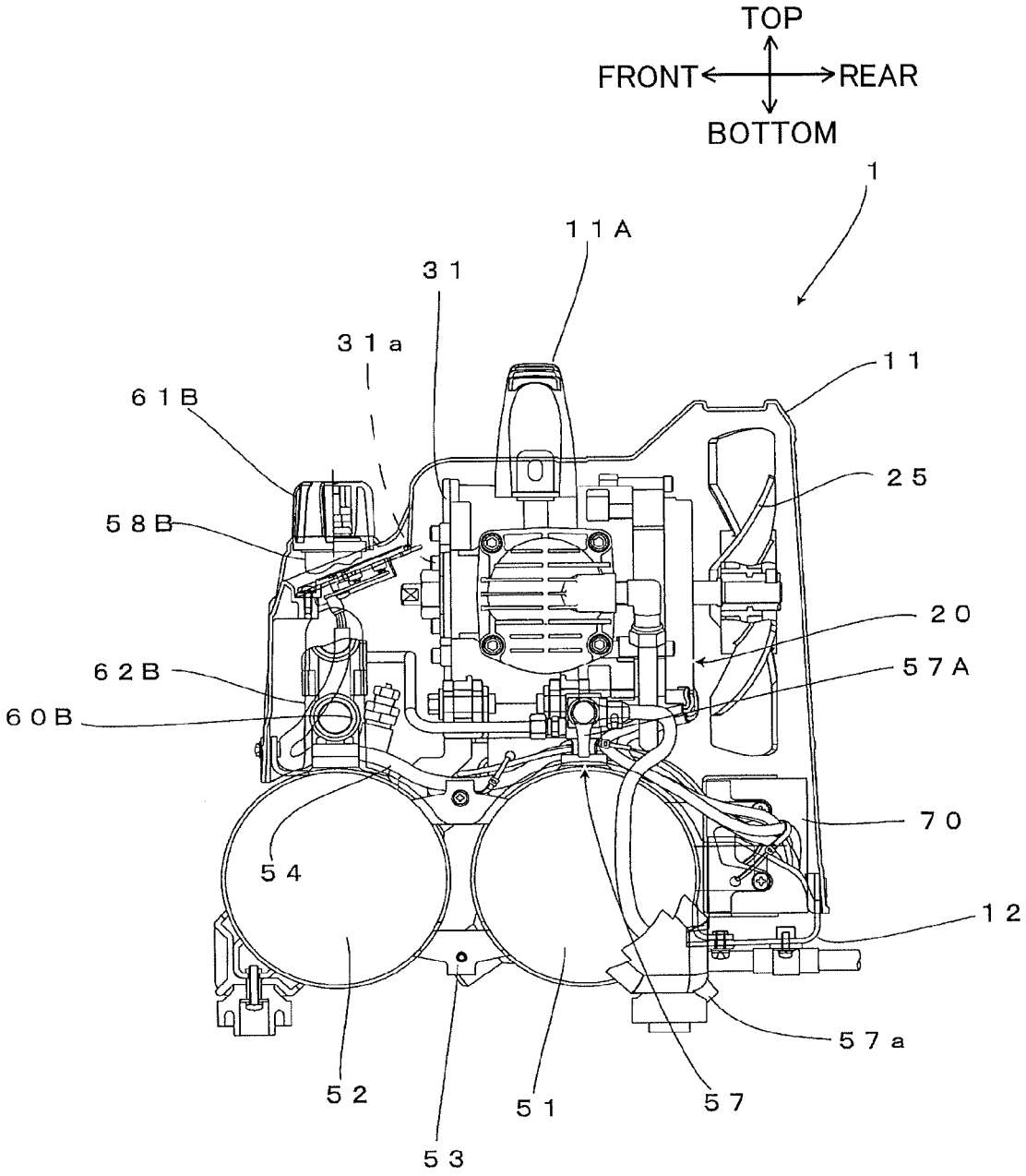
FIG. 2 is a right side view of the air compressor according to the embodiment.

As shown in FIG. 1, the tank unit 50 includes a pair of air tanks 51 and 52, a frame 53, and a communication pipe 54 (FIG. 2). The pair of air tanks 51 and 52 serves to reserve compressed air supplied from the air compression mechanism 30. Each of the air tanks 51 and 52 has a hollow cylindrical configuration having each closed end, and has an axis extending in a left-to-right direction (axial direction). The pair of air tanks 51 and 52 is disposed such that the axis thereof is arranged parallel to each other. That is, the pair of air tanks 51 and 52 is juxtaposed with each other in a front-to-rear direction (array direction). The air tank 52 is adjacent to the endmost air tank 51 in array direction. Further, the one end (left end) of the air tank 51 is arranged in alignment with the one end (left end) of the air tank 52 in the front-to-rear direction, and the remaining one end (right end) of the air tank 51 is also arranged in alignment with the remaining one end (right end) of the air tank 52 in the front-to-rear direction. The pair of air tanks 51 and 52 is supported to the frame 53 fixed to the housing 10 so that the air tanks 51 and 52 are spaced apart from each other at a regular interval in the front-to-rear direction. In other words, the pair of air tanks 51 and 52 is not in contact with each other in the front-to-rear direction, and a gap is formed therebetween (FIG. 2). The interior of the air tank 51 is in communication with the interior of the air tank 52 via the communication pipe 54. The air tank 51 is positioned downstream of the air tank 52 in a direction that compressed air flows. Accordingly, the air tank 51 and the air tank 52 are also respectively referred to as a downstream air tank 51 and an upstream air tank 52. The total weight of the pair of air tanks 51 and 52 and the frame 53 is approximately 3.3 kg. The total volume of the pair of air tanks 51 and 52 is approximately eight (8) liters.

As shown in FIG. 2, the housing 10 covers the motor 20, the axial flow fan 25, the air compression mechanism 30, a major part of the pair of air tanks 51 and 52, and the control unit 70. For the sake of simplicity, FIGS. 1 to 3 are illustrated as if the housing 10 were was transparent. However, in fact, the housing 10 is non-transparent. The housing 10 is made of resin in black. The housing 10 has an upper housing 11 and a lower housing 12. The total weight of the housing 10 including the upper housing 11 and the lower housing 12 is approximately 0.6 kg to 0.7 kg. The upper housing 11 covers a major part of an upper portion of the air tank 52, and a major part of an upper rear portion of the air tank 51. The upper housing 11 has a lower rear edge that is connected to the lower housing 12. The lower housing 12 is positioned so as to confront a lower rear portion of the air tank 51. The lower housing 12 covers the control unit 70 and the lower rear portion of the air tank 51.

The upper housing 11 has a single handle 11A (FIG. 2). The handle 11A protrudes upward from an upper surface of the upper housing 11 and extends in the left-to-right direction. More specifically, the handle 11A is positioned above a center portion of the air tank 51 in the axial direction of the air tank 51 and also above a crank casing 31 (described later). The handle 11A is provided at a position just above the center of gravity of the air compressor 1. The handle 11A is also provided at a position offset from an intermediate position between the axes of the pair of air tanks 51 and 52 in the front-to-rear direction toward the control unit 70 (described later).

The upper housing 11 has a front end portion confronting the crank casing 31, and the front end portion is formed with a plurality of through holes (not shown) for providing communication between the interior and exterior of the upper housing 11. Further, the upper housing 11 has a rear end portion confronting the axial flow fan 25 (described later), and the rear end portion is formed with a plurality of through holes (not shown) for providing communication between the interior and exterior of the upper housing 11. The lower housing 12 has a lower front edge that is spaced apart from the lower rear portion of the air tank 51. More specifically, a gap is formed between the lower front edge of the lower housing 12 and the lower rear portion of the air tank 51, thereby defining an air passage between the interior and exterior of the upper housing 11. Further, the gap formed between the pair of air tanks 51 and 52 also defines an air passage between the interior and exterior of the upper housing 11.

On the upper surface of the upper housing 11, a main power switch (not shown) and an operation panel (not shown) are provided. The air compressor 1 is turned on or off through the main power switch. When the air compressor 1 is turned on, a commercial three-phase AC power supply provides an electrical power with the control unit 70, the motor 20 and the like to drive the same. The operation panel serves to display internal pressure values of the air tanks 51 and 52 and warning signs such as overload.

The motor 20 and the air compression mechanism 30 are disposed inside the upper housing 11, and are positioned above the air tank 51 and in substantially the axial center thereof. The total weight of the motor 20 and the air compression mechanism 30 is approximately 5.7 kg to 5.9 kg. In the present embodiment, a three-phase AC brushless motor is employed as the motor 20. As shown in FIG. 1, the motor 20 includes a stator 21, a rotor 22, and an output shaft 23 that is rotatable integrally with the rotor 22. The motor 20 is disposed such that the output shaft 23 is arranged perpendicular to the axial direction of the air tank 51. The output shaft 23 has a front end portion that extends through the crank casing 31 (described later).

As shown in FIG. 1, the axial flow fan 25 is disposed inside the upper housing 11 at a position rearward of the air tank 51 in the front-to-rear direction. The axial flow fan 25 is provided with a rotation shaft 24 that is also disposed inside the upper housing 11. The rotation shaft 24 is fixed to the output shaft 23 at a rear end portion of the output shaft 23, and is arranged to be coaxial with the output shaft 23. In other words, the rotation shaft 24 extends in a direction parallel to the array direction in which the air tanks 51 and 52 are arrayed. The axial flow fan 25 is fixed to the rotation shaft 24 and rotatable coaxially and integrally with the rotation shaft 24.

The air compression mechanism 30 is connected to the motor 20 and disposed in front of the motor 20. The air compression mechanism 30 is driven by the motor 20 to generate compressed air. As shown in FIG. 1, the air compression mechanism 30 includes the crank casing 31, a first compressor 32, and a second compressor 33. The crank casing 31 is provided with a crank shaft (not shown). The first compressor 32 includes a first cylinder (not shown), a first cylinder head (not shown), and a first piston (not shown) disposed in the first cylinder. The second compressor 33 includes a second cylinder (not shown), a second cylinder head (not shown), and a second piston (not shown) disposed in the second cylinder. The crank shaft provided in the crank casing 31 is configured so as to be rotatable integrally with the output shaft 23 of the motor 20. The crank shaft is drivingly connected to the first and second pistons of the first and second compressors 32 and 33, thereby converting the drive force of the motor 20 to reciprocating movements of the first and second pistons via the crank shaft. The first compressor 32 is provided with a first valve seat (not shown) at a position between the first cylinder head and the first cylinder. The first valve seat is formed with a first inlet port (not shown) and a first outlet port (not shown). The second compressor 33 is provided with a second valve seat (not shown) at a position between the second cylinder head and the second cylinder. The second valve seat is formed with a second inlet port (not shown) and a second outlet port (not shown). The first outlet port is connected to the second inlet port through a tubular member 55. The second outlet port is connected to the air tank 52 through a tubular member 56.

The crank casing 31 has a front portion in which an air intake port 31*a* (FIG. 2) is formed. The air intake port 31*a* provides communication between the interior and exterior of the crank casing 31. The air intake port 31*a* is provided at a position opposing the axial flow fan 25 relative to the motor 20 and the crank casing 31. In other words, the air intake port 31*a* is not in direct confrontation with the axial flow fan 25. Accordingly, airflow generated by the axial flow fan 25 does not directly impinge on the front portion of the crank casing 31 in which the air intake port 31*a* is formed.

As shown in FIG. 2, the air compressor 1 further includes a drain discharging device 57. More specifically, the drain discharging device 57 is disposed above the right end portion of the air tank 51. The drain discharging device 57 is provided with a drain cock 57A and a drain discharge port 57*a*. A user manually operates the drain cock 57A to selectively open and close the drain cock 57A. The drain discharging device 57 is configured such that when the drain cock 57A is opened, drain and compressed air reserved in the air tanks 51 and 52 can be simultaneously discharged from the drain discharge port 57*a* through the communication pipe 54 and a flow passage formed in the drain discharging device 57.

The compressed air take off unit 40 includes decompression valves 58A and 58B, pressure gauges 59A and 59B, compressed air take off ports (couplers) 60A and 60B, pressure regulation handles 61A and 61B for regulating a pressure of compressed air to be taken off, and socket holders 62A and 62B. More specifically, as shown in FIG. 1, the decompression valve 58A, the pressure gauge 59A, the compressed air take off ports 60A, the pressure regulation handle 61A, and the socket holder 62A are disposed above a left portion of the air tank 52, and the decompression valve 58B, the pressure gauge 59B, the compressed air take off ports 60B, the pressure regulation handle 61B, and the socket holder 62B are disposed above a right portion of the air tank 52.

The decompression valve 58A is connected to the downstream air tank 51 via a tubular member (not shown). The pressure regulation handle 61A is attached to and disposed above the decompression valve 58A. The socket holder 62A is threadingly engaged with the decompression valve 58A. The pressure gauge 59A is threadingly engaged with an upper edge of the socket holder 62A. The compressed air take off port 60A is threadingly engaged with a left edge of the socket holder 62A. The compressed air take off port 60A is connectable to a pneumatic tool such as a pneumatically operated fastener driving tool via a hose to supply compressed air to the pneumatic tool.

Likewise, the decompression valve 58B is connected to the downstream air tank 51 via a tubular member (not shown). The pressure regulation handle 61B is attached to and disposed above the decompression valve 58B. The socket holder 62B is threadingly engaged with the decompression valve 58B. The pressure gauge 59B is threadingly engaged with an upper end portion of the socket holder 62B. The compressed air take off port 60B is threadingly engaged with a right end portion of the socket holder 62B. The compressed air take off port 60B is connectable to a pneumatic tool via a hose to supply compressed air reserved in the air tanks 51 and 52 to the pneumatic tool.

With this configuration, the pressure gauges 59A and 59B can monitor pressures of compressed air around the compressed air take off ports 60A and 60B, respectively. Further, regardless of intensity of the pressure of compressed air introduced into the air tanks 51 and 52, the pressures of compressed air at the compressed air take off ports 60A and 60B can be respectively regulated at fixed pressure values by the pressure regulation handles 61A and 61B so that the fixed pressure values are less than or equal to the maximum pressure value. As a result, compressed air with a pressure value less than or equal to the maximum pressure value can be obtained from the compressed air take off ports 60A and 60B.

The control unit 70 is configured to control the motor 20 to start or to stop (turn on or turn off). As shown in FIG. 2, the control unit 70 is disposed inside a rear portion of the upper housing 11 and inside the lower housing 12. The control unit 70 is provided at a position opposite the air tank 52 relative to the air tank 51. More specifically, the control unit 70 is positioned adjacent to the air tank 51 and spaced apart from the rear end portion of the air tank 51 in the front-to-rear direction. A distance between the control unit 70 and the rear end portion of the air tank 51 is approximately 4 mm. Further, the control unit 70 is positioned in direct confrontation with and adjacent to a lower end of an outer circumferential portion of the axial flow fan 25. The control unit 70 is spaced apart from the lower end of the outer circumferential portion of the axial flow fan 25 at a distance of approximately 15 mm in a vertical direction (top-to-bottom direction). The weight of the control unit 70 is approximately 0.9 kg. The control unit 70 has an elongated configuration in a direction parallel to the axis of the air tank 51.

Next, an air compressing operation of the air compressor 1 with the above-described configuration will be described. When the air compressor 1 is in operation, air flows into the upper housing 11 through the plurality of through holes formed in the upper housing 11. Then, the air flows into the crank casing 31 through the air intake port 31*a* in association with the reciprocating movement of the first piston in the first cylinder provided in the first compressor 32. Subsequently, the air flows into the first cylinder through the first inlet port formed in the first valve seat of the first compressor 32. The air is compressed in the first cylinder so as to have a pressure value of 0.7 to 0.8 MPa. The compressed air is taken off from the first outlet port formed in the first valve seat of the first compressor 32 to flow into the second cylinder provided in the second compressor 33 through the second inlet port formed in the second valve seat of the second compressor 33 via the tubular member 55. The compressed air is further compressed in the second cylinder so as to have a pressure value of 3.0 to 4.5 MPa, the allowable maximum pressure value. The further compressed air is taken off from the second outlet port formed in the second valve seat of the second compressor 33 to flow into the air tank 52 through the tubular member 56. The compressed air introduced into the air tank 52 partly flows into the air tank 51 via the communication pipe 54. Hence, the compressed air is reserved both in the air tank 51 and in the air tank 52 at the same pressure.

Figure 3:
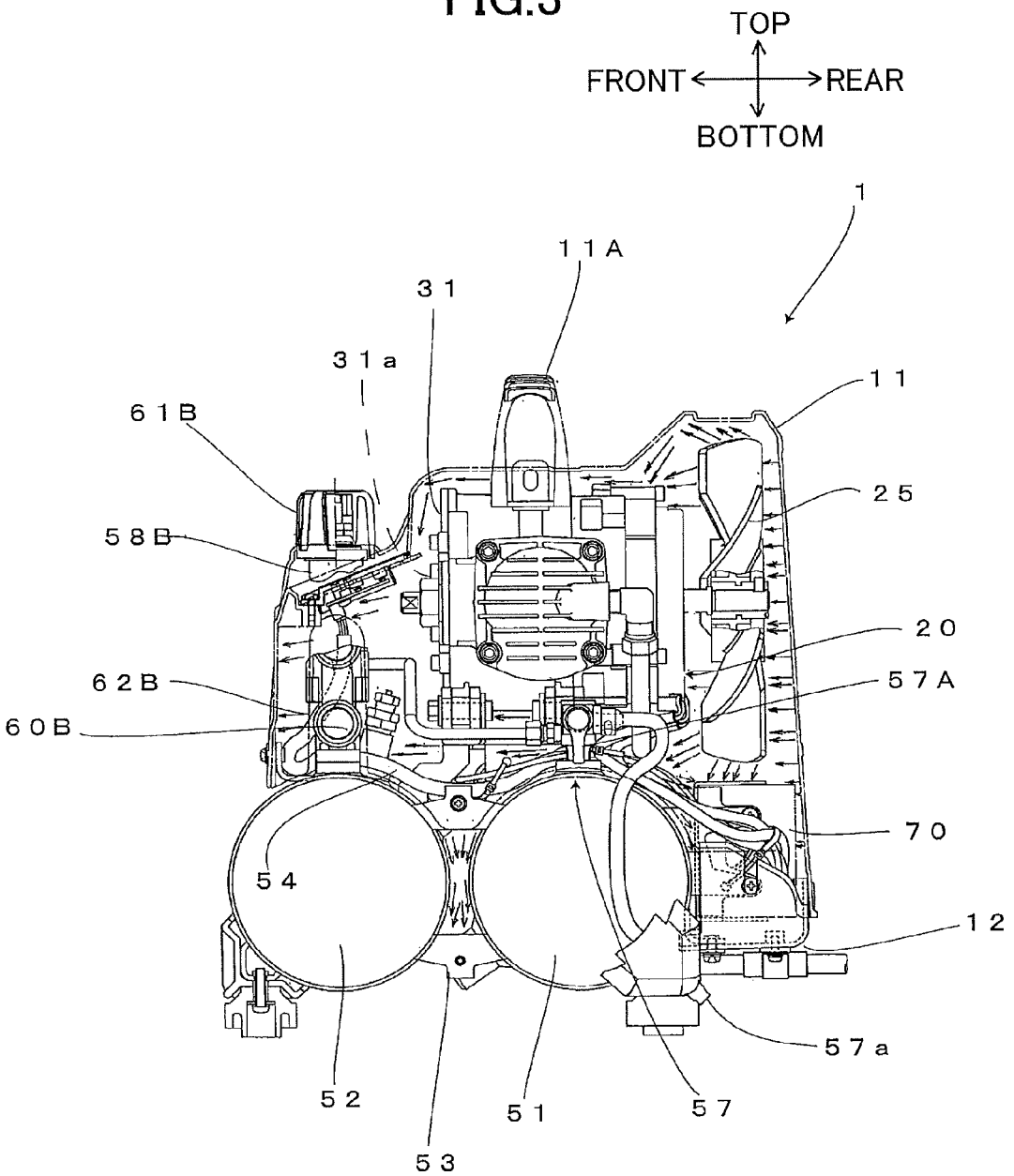
FIG. 3 is a right side view of the air compressor according to the embodiment, in which airflow generated by the fan is indicated by arrows.

As shown in FIG. 3, when the air compressor 1 operates to compress air, air introduced into the upper housing 11 through the plurality of through holes formed in the rear end portion of the upper housing 11 passes over the control unit 70 to impinge upon the upper rear portion of the air tank 51 due to air entrainment in association with the rotation of the axial flow fan 25. A part of the airflow moves downward along the rear portion of the air tank 51 to cool down the control unit 70. Further, airflow generated by the axial flow fan 25 and flowing in the axial direction of the axial flow fan 25 cools down the motor 20 and the air compression mechanism 30.

According to the air compressor 1 in the above-described embodiment, the air compressor 1 includes the control unit 70. The control unit 70 is disposed adjacent to and spaced apart from the air tank 51 at a prescribed distance in the front-to-rear direction. Further, the control unit 70 is provided at a position opposite the air tank 52 relative to the air tank 51 that is disposed juxtaposed with the air tank 52. Further, the control unit 70 is disposed in direct confrontation with and adjacent to the outer circumferential portion of the axial flow fan 25 in the vertical direction. Despite the position of the control unit 70 such that the control unit 70 is disposed so as not to confront the axial flow fan 25 in the axial direction of the axial flow fan 25, air entrainment in association with the rotation of the axial flow fan 25 generates airflow toward the control unit 70. As a result, the control unit 70 can be efficiently cooled.

Further, it is not necessary to dispose the control unit 70 between the air tanks 51 and 52. Accordingly, the degree of freedom in design of the air compressor 1 can be enhanced. Therefore, reduction in size and weight of the air compressor 1 can be easily attained.

The rotation shaft 24 is oriented (extends) in a direction that the pair of air tanks 51 and 52 is juxtaposed (i.e. front-to-rear direction). Further, the axial flow fan 25 is provided at a position opposite the air tank 52 relative to the air tank 51 in the direction. Hence, the axial flow fan 25 and the control unit 70 are disposed not above the pair of air tanks 51 and 52 but offset from the same in the direction. Therefore, the degree of freedom in design of the air compressor 1 can be enhanced. Hence, reduction in size and weight of the air compressor 1 can be easily attained.

The tank unit 50 includes the two air tanks 51 and 52. Compared with a case that more than two air tanks are provided, the total weight of the air tanks 51 and 52 can be reduced. The total volume of the air tanks 51 and 52 can also be reduced but made greater than that of a single air tank.

Further, the tank unit 50 includes the upstream air tank 52 and the downstream air tank 51. The upstream air tank 52 is connected to the air compression mechanism 30, so that compressed air directly flows into the upstream air tank 52. The downstream air tank 51 is connected to the upstream air tank 52, and a part of compressed air introduced into the upstream air tank 52 flows into the downstream air tank 51. With this configuration, the temperature of compressed air reserved in the downstream air tank 51 can be reduced to lower than the temperature of compressed air reserved in the upstream air tank 52. As a result, the control unit 70 that is disposed closer to the downstream air tank 51 than to the upstream air tank 52 can be efficiently cooled.

Further, the housing 10 is provided with the single handle 11A. The handle 11A is provided at a position offset from the intermediate position between the axes of the air tanks 51 and 52 in the front-to-rear direction (i.e. direction that the air tanks 51 and 52 are juxtaposed) toward the control unit 70. Hence, the handle 11A is disposed above the center of gravity of the air compressor 1. Accordingly, portability of the air compressor 1 can be improved, and a user can easily carry the air compressor 1 with one hand.

Further, the air intake port 31*a* is formed in the air compression mechanism 30 to allow air to flow into the crank casing 31. The air intake port 31*a* is provided at a position such that airflow generated by the axial flow fan 25 does not directly impinge upon the air intake port 31*a*. Therefore, the degree of freedom in design of the air compressor 1 can be enhanced. Hence, reduction in size and weight of the air compressor 1 can be easily attained.

The air compressor 1 according to the present invention is useful in the field of portable type air compressors that supply compressed air to pneumatic tools whose power source is compressed air and that are easy to carry.

While the present invention has been described in detail with reference to the embodiment thereof, it would be apparent to those skilled in the art that various changes and modifications may be made therein without departing from the scope of the present invention. For example, while the three-phase AC power brushless motor is used as the motor 20 in the above-described embodiment, other types of motor may be used.

In the above-described embodiment, the tank unit 50 includes the two air tanks 51 and 52. However, the number of air tanks provided in the tank unit 50 is not limited to two. The tank unit 50 may include a plurality of air tanks more than two.

In the above-described embodiment, the rotation shaft 24 is coaxially fixed to the output shaft 23 of the motor 20 at the rear end portion of the output shaft 23. Further, the axial flow fan 25 is coaxially fixed to the rotation shaft 24 and rotatable integrally with the rotation shaft 24. However, the axial flow fan 25 may be coaxially fixed to the output shaft 23 of the motor 20 and rotatable integrally with the output shaft 23.

What is claimed is:

1. An air compressor comprising:

a housing;

a motor disposed in the housing and having a rotor;

an air compression mechanism driven by the motor to generate compressed air;

a rotation shaft rotatable integrally with the rotor;

an axial flow fan disposed in the housing and rotatable integrally with the rotation shaft to generate airflow, the axial flow fan defining an outer circumference;

a plurality of air tanks juxtaposed with each other and arrayed in an array direction, each of the plurality of air tanks having a hollow cylindrical configuration with an axis, each of the plurality of air tanks being configured to reserve the compressed air generated by the air compression mechanism, the plurality of air tanks including an endmost air tank and an adjacent air tank adjacent to the endmost air tank in the array direction; and a control unit configured to control the motor and disposed adjacent to and in confrontation with the outer circumference of the fan, the control unit being disposed such that the endmost tank is disposed between the control unit and the adjacent tank in the array direction.

2. The air compressor according to claim 1, wherein the control unit is spaced apart from the endmost air tank at an interval in the array direction.

3. The air compressor according to claim 1, wherein the rotation shaft extends in a direction parallel to the array direction, the axial flow fan being disposed opposite to the adjacent air tank relative to the endmost air tank in the array direction.

4. The air compressor according to claim 1, wherein the plurality of air tanks is configured of two tanks consisting of the endmost air tank and the adjacent air tank.

5. The air compressor according to claim 4, wherein the adjacent air tank is connected to the air compression mechanism and configured to allow the compressed air generated by the air compression mechanism to directly flow thereinto, the endmost air tank being connected to the adjacent air tank and configured to allow a part of the compressed air reserved in the adjacent air tank to flow thereinto.

6. The air compressor according to claim 4, wherein the housing includes a handle provided at a position offset from an intermediate position between the axes of the endmost air tank and the adjacent air tank toward the control unit in the array direction.

7. The air compressor according to claim 1, wherein the air compression mechanism has a casing formed with an air intake port for allowing air to flow into the casing, the air intake port being positioned such that impingement of the airflow generated by the axial flow fan upon the air intake port is prevented.

8. An air compressor comprising:

a housing;

a motor disposed in the housing and having a rotor;

an air compression mechanism driven by the motor to generate compressed air;

a rotation shaft rotatable integrally with the rotor;

an axial flow fan disposed in the housing and rotatable integrally with the rotation shaft to generate airflow, the axial flow fan defining an outer circumference;

a plurality of air tanks juxtaposed with each other and arrayed in an array direction, each of the plurality of air tanks having a hollow cylindrical configuration elongated parallel to an air tanks elongate axis, the air tanks being configured to reserve the compressed air generated by the air compression mechanism and the plurality of air tanks including an endmost air tank and an adjacent air tank adjacent to the endmost air tank in the array direction; and a control unit configured to control the motor, wherein the rotation shaft extends in a direction substantially perpendicular to the air tanks elongate axis, and wherein the control unit has an elongated configuration in a direction parallel to the air tanks elongate axis and is disposed such that the endmost tank is disposed between the control unit and the adjacent tank in the array direction and in direct confrontation with and adjacent to the outer circumference of the fan so as to be cooled via radial airflow generated by rotation of the axial flow fan.

9. The air compressor according to claim 1, wherein the control unit is disposed within the housing.

10. The air compressor according to claim 8, wherein the control unit is disposed within the housing.

11. The air compressor according to claim 9, wherein the control unit is disposed adjacent to a lower end of the outer circumference of the fan.

12. The air compressor according to claim 10, wherein the control unit is disposed adjacent to a lower end of the outer circumference of the fan.

* * * * *